169-47 SR

7/7/81 OR 4,276,938

United States Patent [19]

Klimenko et al.

[11] 4,276,938

[45] Jul. 7, 1981

[54] METHOD AND APPLIANCE FOR FIRE EXTINGUISHING IN ENCLOSED COMPARTMENT

[76] Inventors: Alexandr S. Klimenko, Leningradskoe shosse, 118, korpus 1, kv. 91; Igor V. Emelyanov, Leningradsky prospekt, 60-A, kv. 137; Anatoly A. Krylov, Eniseiskaya ulitsa, 11, kv. 95; Semen A. Yantovsky, ulitsa 26 Bakinskikh komissarov, 3, korpus 3, kv. 240, all of Moscow, U.S.S.R.

[21] Appl. No.: 959,416

[22] Filed: Nov. 13, 1978

[51] Int. Cl.[3] ..... A62C 3/02

[52] U.S. Cl. ..... 169/47; 169/57; 169/26

[58] Field of Search ..... 169/26, 28, 42, 46, 169/47, 57, 84; 137/72

[56] References Cited

U.S. PATENT DOCUMENTS

| | | | |
|---|---|---|---|
| 1,453,091 | 4/1923 | Delbare | 169/28 |
| 2,736,386 | 2/1956 | Klompar | 169/28 X |
| 2,917,116 | 12/1959 | Wyant | 169/57 |
| 3,040,815 | 6/1962 | Pambello | 169/57 |
| 3,687,329 | 8/1972 | Baum | 169/57 X |

FOREIGN PATENT DOCUMENTS

| | | | |
|---|---|---|---|
| 2076336 | 10/1971 | France | 169/28 |
| 555896 | 6/1977 | U.S.S.R. | 169/28 |

*Primary Examiner*—Robert J. Spar
*Assistant Examiner*—Fred A. Silverberg
*Attorney, Agent, or Firm*—Lackenbach, Lilling & Siegel

[57] ABSTRACT

The method and appliance for fire extinguishing according to the present invention are suitable for use in stationary depot premises, baggage and engineering compartments of transportation facilities, etc. According to the method of the invention, at a suitable position in a compartment, an individual container is fixed, which is fitted with a fuse 3 responding to infrared radiation and carries a fire extinguishing compound whose function is effectuated by a chemically active liquid inhibitor confined in miniature capsules made from thermoplastic material and which is distributed over the compartment after ignition of the fuse 3 by conversion from a liquid to a gas. Vapors of the gaseous inhibitor escape from the container and produce a noncombustible atmosphere in the compartment. The appliance for performing this method embodies a container made non-gastight and fitted with a thermal charge placed inside it in the form of a rod manufactured from a highly inflammable oxygen-containing substance. Raising the temperature in the compartment after ignition of the fuse will destroy the material of the miniature capsules and change the inhibitor from a liquid to a gas. This allows for quickly extinguishing a fire by producing a neutral noncombustible atmosphere in the compartment.

11 Claims, 3 Drawing Figures

METHOD AND APPLIANCE FOR FIRE EXTINGUISHING IN ENCLOSED COMPARTMENT

BACKGROUND OF THE INVENTION

The present invention relates to methods and means of fire extinguishing and may be applicable to enclosed compartments, for example, stationary depot premises, laboratories, baggage and engineering compartments of transportation facilities, etc.

At the present time there are known methods for fire extinguishing in enclosed compartments wherein the fire extinguishing medium is distributed over the compartment upon operation of a fire detector.

The fire extinguishing medium is distributed over the compartment in different ways, for example, by spraying the extinguishant over the compartment from storage cylinders through sprinkler heads (cf. British Pat. No. 1,053,920; U.S. Pat. Nos. 3,811,511; 3,878,897).

Installations for accomplishing this method utilize temperature indicators (fire detectors), fire alarm amplifiers, extinguishant storage tanks, electric cocks, pipe lines and extinguishant sprinkler heads. These installations become operable automatically or manually.

However, installations using a great number of components become complex, which reduces their reliability and efficiency, as their operation is dependent upon the reliability of all units incorporated thereinto. Moreover, said system requires a large useful space to arrange the units, is complicated in operation, has a large mass, may be applicable, substantially, in stationary premises and consumes a great amount of fire extinguishing compound.

There is also known a method for fire extinguishing in an enclosed compartment (cf. French Pat. No. 2,076,336) which utilizes a directed explosion to deliver an extinguishant to the source of the fire. An appliance accomplishing this method incorporates a container of extinguishant in solid state (in powder), a fuse placed outside the container and made in the form of a pyrotechnic chain, and an explosive charge situated inside the container which explodes upon operation of the pyrotechnic chain to expel the fire extinguishing powder.

However, this method and appliance for fire extinguishing does not provide a means for producing a noncombustible atmosphere in the compartment or to discharge the powder directly into the inner hemisphere of the container, to quench a fire only within the preset radius of action, i.e., in that area where the extinguishing powder is deposited directly on the source of the fire. The space beyond the reach of the powder remains on fire. The effective use of the fire extinguishant is limited. Furthermore, the fire extinguishing appliance is put in operation through a chain of intermediate links. The failure of one of these intermediate links may disturb the operation of the whole appliance, which reduces its dependability.

It is an object of the present invention to overcome the above disadvantages.

The principal object of this invention is to provide a reliable and efficient method of extinguishing fire in an enclosed compartment.

Another object of the invention is to provide a method of fire extinguishing which will produce a noncombustible atmosphere in the entire volume of the compartment without regard to where the fire arises and its extent at the time the appliance becomes operable.

Yet another object of the invention is the provision of an appliance for fire fighting which will allow for efficient and reliable use of a fire extinguishant.

To accomplish the foregoing and related objects a method of fire extinguishing in an enclosed compartment resides in a fire extinguishant placed in an individual container which is distributed over the compartment after the fuse ignition. According to the invention, the fire extinguishant is a chemically active inhibitor in liquid state confined in thermoplastic miniature capsules, which are distributed over the compartment and changed to a gaseous state under the influence of the temperature rising in the container after the fuze ignition, rupturing the capsule material and evaporating the inhibitor whose vapors leave the container and produce a noncombustible atmosphere in the compartment.

The fire extinguishant kept (stored) in the miniature capsules stays effective for a long period of time without the necessity for special sealed vessels.

The thermoplastic nature of the miniature capsules makes it possible to rapidly break the miniature capsules, to transform the liquid chemically active inhibitor to a gaseous state and to distribute it over the compartment under the influence of the temperature of the burning fuse and thermal charge and the influence of open flames in the compartment.

The five extinguishant (the chemically active inhibitor) distributed over the compartment in the gaseous state provides a means for reliable fire control by producing in the compartment the neutral noncombustible atmosphere with a minimum consumption of the extinguishant thereby making it impossible for the fire to begin again in the compartment for a definite period of time depending upon the compartment ventilation rate.

It is expedient that the chemically active inhibitor be liquid freon since liquid freon quickly turns to a gaseous state at ambient temperature and considerably expands in volume, which makes it possible to produce the noncombustible atmosphere in the compartment with the use of small amounts of the fire extinguishant.

It is also expedient that liquid freon be confined in the miniature capsules under pressure to provide for a more intensive breaking-up of the miniature capsules, distribution of freon over the compartment and creation of the non-combustible atmosphere.

An appliance designed for accomplishing the proposed method comprises an extinguishant container fastened in a compartment, a fuse placed outside the container responding to infrared radiation, and a charge placed inside the container to distribute the extinghishant over the compartment after ignition of the fuse. The invention utilizes as a fire extinguishant, a chemically active inhibitor in a liquid state confined in miniature capsules made from a thermoplastic material, and as a charge, a thermal charge made in the form of a rod of a highly inflammable oxygen-containing substance, which raises the temperature in the container after ignition of the fuse to cause the miniature capsules to break and the inhibitor to change from a liquid to a gas, the container being gas-permeable to allow the gaseous inhibitor to escape into the compartment and to produce the noncombustible atmosphere therein.

Thus, the appliance provides a simple means for accomplishing the proposed method and for producing the noncombustible atmosphere in the compartment.

In accordance with the invention, a thermal charge is placed in a perforated sleeve fixed in a container with its open butt end extending from the container and meant for securing a fuse, which makes it possible to create optimum conditions for using the thermal energy of the thermal charge to break the miniature capsules, to evaporate the inhibitor and to distribute it over the compartment.

It is expedient that in the perforated sleeve, between the thermal charge and fuse there be a non-return valve opening in the direction of the thermal charge, which eliminates leakage of combustible gases beyond the container and allows the thermal charge energy to be used more completely to break the miniature capsules and to evaporate the inhibitor.

The invention is also characterized by the thermal charge and fuse being made in the form of a rod thereby enhancing the operating efficiency of the appliance and simplifying its design.

The invention is further characterized by the fuse which may be made in the form of several rods fixed in a hemispherical shell fastened to the open butt end of the perforated sleeve.

It is expedient that the fuse portion protruding beyond the container be combined within an envelope made from highly heat-conducting material which does not interfere with the fuse ignition as prevent the discharge of hot gases into the compartment.

Thus, the proposed method and appliance for fire extinguishing in an enclosed compartment provides a means for quickly quenching fires, requires a lesser amount of an extinguishant and is reliable in operation.

BRIEF DESCRIPTION OF THE DRAWINGS

The invention will now be described in greater detail with reference to a specific embodiment thereof, taken in conjunction with the accompanying drawings, wherein.

Figure 1:
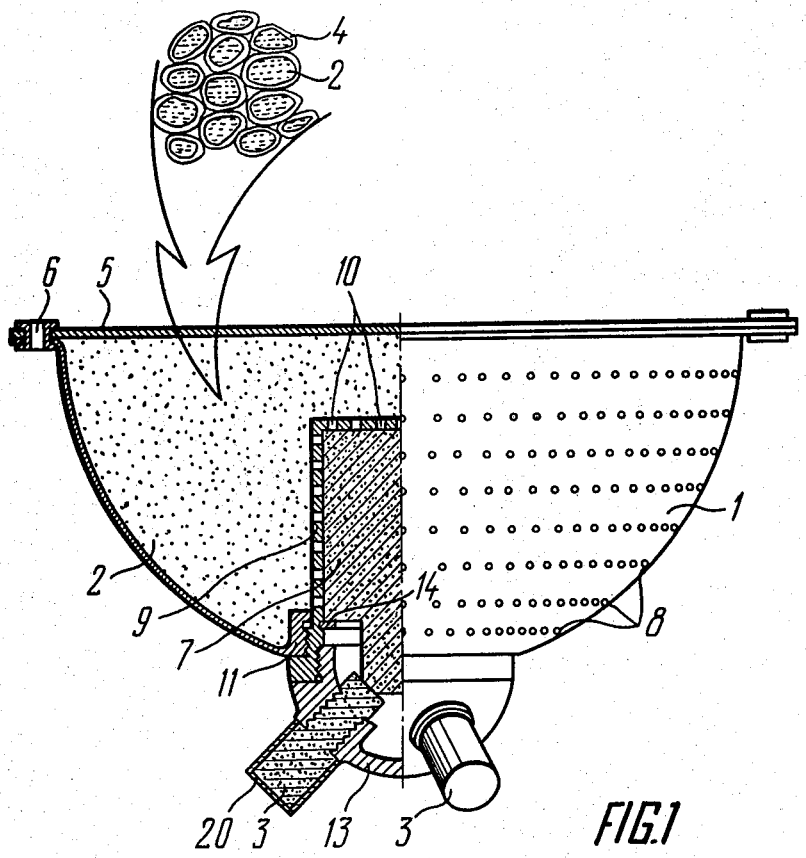
FIG. 1 is a semisectional general view of the appliance for fire extinguishing in accordance with the invention.

The proposed method of fire fighting in an enclosed compartment provides that at a suitable location in the compartment and in any conventional way, a container 1 (FIG. 1) is positioned, containing a fire extinguishant 2 and a fuse 3 placed outside the container 1 which responds to infrared radiation produced by a fire.

Used as the fire extinguishant 2 is a chemically active liquid inhibitor which exerts an active influence on the chemical reaction of combustion by entering into reaction with burning products, attended by considerable heat absorption, for example, halogen-based combinations containing fluorine, chloride, bromine, etc. Used as a chemically active inhibitor in a liquid state may be, for example, freon (difluorochlorobromomethane $CF_2ClBr$ or tetrafluorodibromoethane $C_2F_4Br_2$), compositions based on ethyl-bromide, methylene-bromide and the like, commonly known to those skilled in the art. The chemically active inhibitor is individually adapted for particular conditions wherein it will be used (living, depot premises, baggage and engineering compartments of transportation facilities, cargo containers, etc.).

The method and appliance therefore will become more apparent from the following description of a preferred embodiment utilizing liquid freon as a chemically active inhibitor.

Inasmuch as use is made of liquid freon, for ease of storing it in the container 1 freon is confined under pressure in miniature capsules 4 made from thermoplastic material, for example, gelatin.

In case of fire, freon is distributed over the compartment after ignition of the fuse 3 to produce the noncombustible atmosphere in this compartment. To make freon capable of being distributed, it is changed from a liquid to a gas under the influence of the temperature rising in the container after ignition of the fuse 3 and breaking the material of the miniature capsules and evaporating freon, whose vapors escape from the container and produce the noncombustible atmosphere in the compartment.

The material of the miniature capsules 4 and the substance, from which the fuse 3 is made, are selected from amongst the materials known to those skilled in the art and are determined by particular conditions in which the proposed method is used.

Given below is a description of the appliance for accomplishing the proposed method of fire extinguishing in an enclosed compartment, the quantity of these appliances fitted in the enclosed compartment being determined by the degree of fire hazard in this compartment and by conditions of arrangement of flammable objects in the compartment.

The appliance comprises the container 1 with the fire extinguishant 2 suitably placed in the compartment. The container 1 is dome-shaped and is fitted with a flat cover plate 5, which is situated parallel to the wall (ceiling) of the compartment and fastened to it by means of any conventional fasteners through holes 6.

Placed outside the container 1 is the fuse 3, while placed inside the container over the fuse 3 is a charge distributing the extinguishant over the compartment after ignition of the fuse to produce the noncombustible atmosphere in the compartment.

The fuse 3 is made of an oxygen-containing material, for example, an explosive compound (powder) known to those skilled in the art and igniting as the temperature in the compartment rises above the design value, i.e., responding to infrared radiation.

As the fire extinguishant 2, use is made of a chemically active inhibitor in a liquid state, for example freon (difluorochlorobromomethane $CF_2ClBr$ or tetrafluorodibromoethane $C_2F_4Br_2$ and the like), compositions based on ethyl-bromide, methylene-bromide, etc.

The freon inhibitor is confined under pressure in the miniature capsules placed in the container, the capsules being made from a thermoplastic material known to those skilled in the art, for example, gelatin, which quickly melts as the temperature rises in the container 1.

Used as a charge is a thermal charge 7 made in the form of a rod manufactured from a conventional highly inflammable oxygen-containing substance which, on ignition of the fuse 3, raises the temperature in the container causing the miniature capsules 4 to melt and freon to change from a liquid to a gas. The burning fuse 3 is a means of igniting the thermal charge 7 which burns thus producing in the container the conditions (raises the temperature) required to break the miniature capsules 4 and to change freon from a liquid to a gaseous state.

To allow gaseous freon vapors to escape from the container 1 on ignition of the fuse 3 and the thermal charge 7, the container 1 is made gas-permeable, with holes 8 having a diameter smaller than that of the miniature capsules 4.

To provide for uniform action of the burning thermal charge 7 on the miniature capsules 4, the thermal charge 7 is placed into a perforated sleeve 9, whose bottom faces the cover plate 5 of the container, and the open butt end extends from the container 1. Holes 10 are made both in the side walls and the bottom of the sleeve 9. The sleeve 9 is secured in the container 1 through a threaded joint provided on the external surface of the sleeve 9 and in a thickened portion 11 of the container 1.

Figure 2:
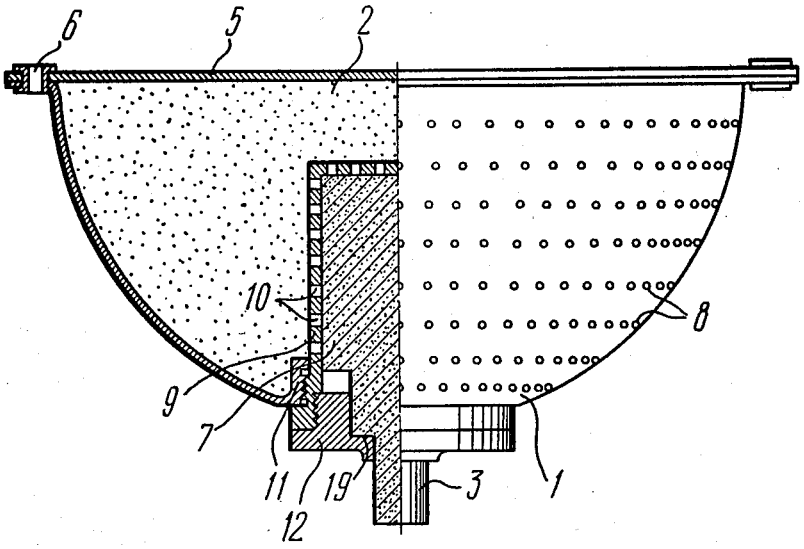
FIG. 2 represents the appliance of FIG. 1 with another embodiment of the fuse.
Figure 3:
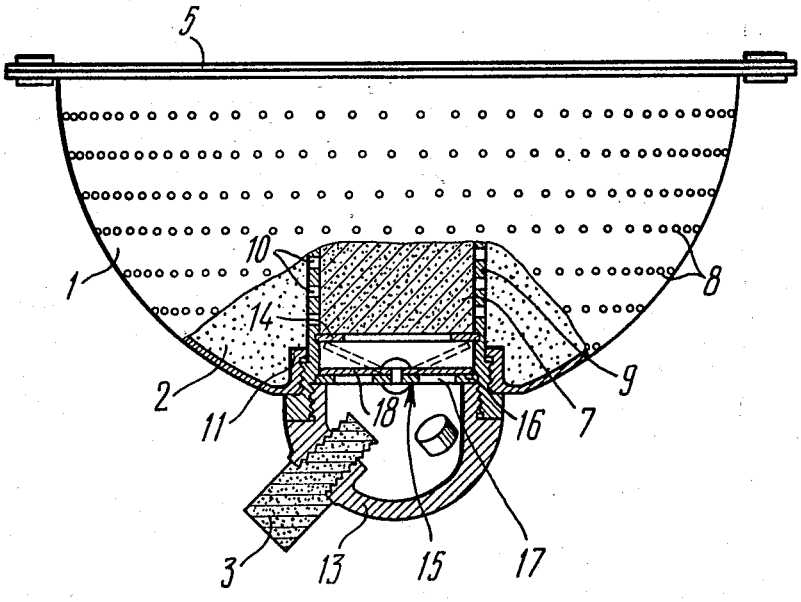
FIG. 3 shows the appliance of FIG. 1 with a nonreturn valve located between the thermal charge and fuse.

The open butt end of the sleeve 9 is made suitable for securing the fuse 3, for example, by means of a flat cover plate 12, with a threaded joint as shown in FIG. 2, or a hemispherical shell 13, as shown in FIGS. 1 and 3.

The thermal charge 7 is held in the sleeve 9 by means of a spacing washer 14.

FIG. 3 represents the container wherein between the thermal charge 7 and the fuse 3 there is situated a nonreturn valve 15 opening in the direction of the thermal charge 7, the valve being provided with a disk 16 with holes 17, in the central part of the disk 16 being fastened are spring tabs 18 arranged above the holes 17 and opening these holes under the action of hot gases liberated in combustion of the fuse 3. The tabs 18 in the raised position are shown in dotted line in FIG. 3. The nonreturn valve 15 eliminates the possibility of hot gases escaping from the sleeve 9 through its open butt end in combustion of the thermal charge 7.

FIG. 2 represents the container wherein the thermal charge 7 and the fuse 3 are made in the form of one rod whose lower part extending from the sleeve 9 is the fuse 3, which in this particular case may be manufactured from the same material as the thermal charge and is held in the sleeve 9 by a flange 19 of the flat cover plate 12.

FIGS. 1 and 3 show the container 1 fitted on its outside with several fuses 3 made in the form of rods secured, for example, by means of a threaded joint in the holes of the hemispherical shell 13.

In this case the rod fuses 3 may directly contact the thermal charge 7, as shown in FIG. 1. However, there may be a clearance space between them, as shown in FIG. 3, which does not prevent the rapid ignition of the thermal charge 7 in case of fire in the compartment, as heat of the burning fuses is transmitted without difficulty to the thermal charge 7.

The part of the fuses 3 (or of one fuse) extending from the container are enclosed in an envelope 20 made from highly heat-conducting material, for example, copper, at least 0.1 mm thick.

The proposed appliance operates in the following way.

As the temperature in the enclosed compartment rises above the design value or an open flame (fire) occurs, the fuse 3 (or fuses) ignite. The thermal charge 7 catches fire from the burning fuse 3. As this takes place, hot gases released from the thermal charge 7 escape through the holes 10 of the sleeve 9 into the container 1, which causes the temperature in the container to sharply rise. Under the influence of this temperature the miniature capsules 4 melt and liquid freon changes to a gas. As the thermal charge 7 burns away, miniature capsules 4 are destroyed.

Since the change of freon from a liquid to a gas causes the pressure in the container 1 to increase, gaseous freon escapes through the holes of the container and fills the compartment, thereby producing the noncombustible atmosphere, as a result the fire in the compartment is put out.

The noncombustible atmosphere may be produced in the compartment even if a rise of the temperature in the compartment for some reason of other does not cause ignition of the fuse and thermal charge. If this is the case, the material of the miniature capsules becomes destroyed under the influence of the elevated temperature in the compartment, liquid freon turns to a gas and its vapors escape through the container holes, thereby producing the noncombustible atmosphere in the compartment.

The use of the proposed fire extinguishing method and appliance does not prevent the possibility of arranging in this compartment any other conventional appliances indicating an outbreak of fire in the compartment and operation of the proposed appliance.

What is claimed is:

1. A method for fire extinguishing in an enclosed compartment by using a chemically active liquid inhibitor as a fire extinguishant; wherein said chemically active inhibitor is confined in miniature capsules made from a thermoplastic material and placed in an individual gas permeable container located in the enclosed compartment and fitted with a fuse extending outside the container and responsive to infrared radiation; said chemically active inhibitor being distributed over the compartment after ignition of the fuse, which acts to change the chemically active inhibitor from a liquid to a gas under the indluence of the temperature rising in the container after ignition of said fuse, destroying the material of the miniature capsules and evaporating the inhibitor whose vapors escape from openings in the container and produce a noncombustible atmosphere in the compartment.

2. A method as claimed in claim 1, wherein the chemically active inhibitor is liquid freon.

3. A method as claimed in claim 2, wherein said liquid freon is confined in the miniature capsules under pressure.

4. An appliance for fire extinguishing in an enclosed compartment, comprising: at least one container fixed in the compartment; a fuse placed outside said container responsive to infrared radiation; a fire extinguishant, comprising a chemically active liquid inhibitor confined in miniature capsules made from a thermoplastic material and arranged in said container; a charge placed inside said container designed to distribute said extinguishant over the compartment after ignition of the fuse; said charge comprises a thermal charge made in the form of a rod manufactured from a highly inflammable oxygen-containing substance which raises the temperature in said container after ignition of the fuse and causes the material of the miniature capsules to break and the inhibitor to change from a liquid to a gas; said container being gas-permeable to allow the gaseous inhibitor to infiltrate the compartment and produce a noncombustible atmosphere therein.

5. An appliance as claimed in claim 4, comprising: a perforated sleeve designed to accommodate the thermal charge and fixed in said container, an open butt end of the perforated sleeve extending from the container is intended to secure the fuse; means for securing the fuse in the open butt end of the perforated sleeve.

6. An appliance as claimed in claim 5, comprising a nonreturn valve situated between the charge and the fuse and open in the direction of the thermal charge.

7. An appliance as claimed in claim 5, wherein the thermal charge and fuse are made in the form of one rod.

8. An appliance as claimed in claim 5, comprising the fuse in the form of several rods, a hemispherical shell secured in the open butt end of the perforated sleeve and provided with holes accommodating the fuses.

9. An appliance as claimed in claim 4, wherein the part of the fuse extending from the container is enclosed in an envelope made from highly heat-conducting material.

10. A method for fire extinguishing in an enclosed compartment by using a chemically active liquid inhibitor as a fire extinguishant; wherein said chemically active inhibitor is confined in miniature capsules made from a thermoplastic material and placed in an individual gas permeable container located in the enclosed compartment and fitted with a fuse extending outside the container and responsive to infrared radiation; said chemically active inhibitor being distributed over the compartment in a nonreturnable direction after ignition of the fuse, which acts to change the chemically active inhibitor from a liquid to a gas under the influence of the temperature rising in the container after ignition of said fuse, destroying the material of the miniature capsules and evaporating the inhibitor whose vapors escape from openings in the container and produce a noncombustible atmosphere in the compartment.

11. An appliance for fire extinguishing in an enclosed compartment, comprising: at least one container fixed in the compartment; a fuse placed outside said container responsive to infrared radiation; a fire extinguishant comprising a chemically active liquid inhibitor confined in miniature capsules made from a thermoplastic material and arranged in said container; a charge placed inside said container designed to distribute said extinguishant over the compartment after ignition of the fuse; a nonreturn valve located between the charge and the fuse and open in the direction of the thermal charge, said charge being effected by a thermal charge made in the form of a rod manufactured from a highly inflammable oxygen-containing substance which raises the temperature in said container after ignition of the fuse and causes the material of the miniature capsules to break and the inhibitor to change from a liquid to a gas; said container being gas-permeable to allow the gaseous inhibitor to infiltrate the compartment and produce a noncombustible atmosphere therein.

* * * * *